United States Patent [19]

Forgo

[11] 4,240,723

[45] Dec. 23, 1980

[54] PROCESS FOR ELECTROGRAPHIC IMAGE PRODUCTION AND AN APPARATUS FOR CARRYING OUT THIS PROCESS

[75] Inventor: Gabor Forgo, Zurich, Switzerland

[73] Assignee: Elfotec A.G., Zumikon, Switzerland

[21] Appl. No.: 578,249

[22] Filed: May 16, 1975

[30] Foreign Application Priority Data

May 20, 1974 [DE] Fed. Rep. of Germany ..... 2424350

[51] Int. Cl.[3] ..... G03G 15/00; G03G 21/00

[52] U.S. Cl. ..... 355/3 DD; 355/15; 430/125

[58] Field of Search ..... 355/3 DD, 15, 17; 430/125

[56] References Cited

U.S. PATENT DOCUMENTS

| | | | |
|---|---|---|---|
| 2,874,063 | 2/1959 | Greig | 355/17 X |
| 2,986,442 | 5/1961 | Broding | 355/16 X |
| 3,580,673 | 5/1971 | Yang | 355/15 |
| 3,622,237 | 11/1971 | Von Grabe | 355/15 |
| 3,637,306 | 1/1972 | Cooper | 355/15 |
| 3,639,245 | 2/1972 | Nelson | 252/62.1 P |
| 3,647,293 | 3/1972 | Queener | 355/15 |
| 3,759,220 | 9/1973 | Saito et al. | 355/15 X |
| 3,914,045 | 10/1975 | Namiki et al. | 355/15 |

*Primary Examiner*—Fred L. Braun

*Attorney, Agent, or Firm*—Arnstein, Gluck, Weitzenfeld & Minow

[57] ABSTRACT

A process for a latent electrostatic image or a conductivity image on a photoconductor, a single-component magnetic toner being used for development and a magnetic brush being used not only for application of the toner to the image, but also for removal of residual toner. The brush may be one and the same brush for both tasks or separate brushes identical in structure may be used for each of the two tasks.

4 Claims, 2 Drawing Figures

PROCESS FOR ELECTROGRAPHIC IMAGE PRODUCTION AND AN APPARATUS FOR CARRYING OUT THIS PROCESS

BACKGROUND OF THE INVENTION

1. Field of the Invention

This invention relates to a process for electrographic image production and to an apparatus for carrying out this process. More particularly, the invention is concerned with the problem of cleaning a repeatedly usable intermediate image carrier of an electrographic copier. In the context of the invention, an "intermediate image carrier" is either a charge image carrier on which a latent electrostatic charge image can be produced, or a conductivity image carrier on or in which a latent conductivity image can be produced.

2. Description of the Prior Art

Various processes for electrographic image production are already known. The present invention relates in particular to processes of the kind in which a latent electrostatic charge image is produced on a repeatedly usable image carrier, more especially a charge image carrier comprising a photoconductor, the latent charge image being dry-developed by means of a so-called magnetic brush. The manner in which the electrostatic charge image is produced is of no significance to the present invention. Accordingly, the invention is applicable both to image-producing processes of the type in which a uniformly distributed electrical charge is applied in darkness to a repeatedly usable photoconductor as charge image carrier and the photoconductor thus charged is selectively discharged by exposure to light in dependence upon the original or master in order to produce an electrostatic latent charge image dependent upon the original, and also to so-called PIP image production processes where an internal polarization effect of the charge image carrier is utilized (cf. for example Journal of Applied Optics, 1969, Supplement 3, Electrography, pages 170–175, "Electrophotography by Persistent Polarization Due to Inverse Field", and also to other electrographic image production processes in which a charge image or a conductivity image has to be developed on a carrier).

In conventional magnetic brushes of the kind normally used for developing the above-mentioned latent electrostatic charge images, a toner powder, chargeable by frictional electricity, is used in admixture with magnetizable, powder-form material, for example, iron or iron oxide, as developer in order to produce a brush-like coating consisting of toner particles and magnetizable particles on a support equipped with at least one magnetic system, for example, in the form of an aluminum cylinder. Accordingly, the coating consists of two different components, namely the toner particles and the magnetizable particles. Accordingly, developers of this kind are normally referred to as two-component toners. The toner particles present in the coating are charged by frictional electricity, for example, with positive polarity. During the passage of the intermediate image carrier bearing a charge image, for example, with negative polarity, together with the coating of the magnetic brush, toner particles which previously have been positively charged by frictional electricity are removed from the coating by the charge image and retained on the intermediate image carrier corresponding to the latent charge image. A toner image is formed on the photoconductor or intermediate image carrier, being subsequently transferred to a second, definitive image carrier in known manner by a toner transfer process.

It has now been found that, following transfer of the toner image to the definitive image carrier, residues of the toner material are always left behind on, and soil, the intermediate image carrier. Conventional toner transfer processes have an efficiency of only about 60 to 80%, so that a significant proportion of the toner material previously transferred to the intermediate image carrier is left behind on it after the image has been transferred to the definitive image carrier.

Accordingly, the intermediate image carrier has to be cleaned, generally after each image-producing cycle but at the very least after a change of original, in other words toner residues left behind on it have to be removed in order to be able to commence the following image-producing cycle with a clean intermediate image carrier.

Cleaning may be carried out with brushes and, in particular, even with magnetic brushes of the kind referred to earlier on. Removal of the toner residues is improved by applying to the cleaning brush a voltage of opposite polarity to the toner residues left on the charge image.

It has also been proposed (cf. U.S. Pat. No. 3,647,293) to provide the image-producing apparatus with only one magnetic brush and to use this brush both for developing the latent image on the intermediate image carrier and also for subsequently cleaning the intermediate image carrier, the polarity of a d.c. voltage applied between the intermediate image carrier and the magnetic brush for the development process being opposite to the polarity of the d.c. voltage applied for the cleaning process.

One disadvantage of the above-mentioned conventional processes and apparatus is the considerable outlay involved in generating the above-mentioned d.c. voltage to be applied with alternating polarity, and in particular the changes in toner content and, hence, in the mixing ratio of the developer which occur in conventional processes and apparatus. The removal of toner particles for image production weakens the developer mixture, consisting of magnetizable material and toner particles, with increasing number of image-producing cycles. Accordingly, fresh toner particles have to be introduced at least periodically into the developer mixture in order to obtain images of uniform quality. Considerable difficulties are involved in obtaining the correct dosage for the fresh toner particles to be introduced and also in correctly mixing them with the developer still present consisting of magnetizable material and toner particles. The reason why these difficulties are so great is that it is extremely difficult in practice to determine the mixing ratio at any particular moment and, hence, to calculate the effective quantity of fresh toner required with sufficient accuracy. In addition, experience has shown that the magnetizable material also deteriorates during use of the developer, so that it also has to be periodically replaced. However, replacement of the magnetizable material involves considerable difficulties in practice on account of the very strong magnetic system present in the magnetic brush.

SUMMARY OF THE INVENTION

Accordingly, the object of the present invention is to provide a simple process for electrographic image production and an apparatus suitable for carrying out this process, which guarantee constant image quality by virtue of constant developer properties and in which the intermediate image carrier can be cleaned particularly easily.

Accordingly, the present invention relates to a process for electrographic image production, in which at least one magnetic brush is provided both for developing a latent electrostatic charge image or conductivity image and for cleaning an intermediate image carrier, distinguished by the fact that a magnetic one-component toner is used for forming the brush-like coating on the magnetic brush.

The invention also relates to an apparatus for carrying out this process, which apparatus is distinguished by the fact that at least one magnetic brush, whose brush-form coating consists of a magnetic one-component toner, is provided both for developing a latent electrostatic charge image or conductivity image on an intermediate image carrier and for removing toner residues from the intermediate image carrier.

BRIEF DESCRIPTION OF THE DRAWING

The invention is described by way of example in the following with reference to the accompanying drawing, wherein.

In all the Figures, identical components are denoted by the same reference numerals.

DESCRIPTION OF THE PREFERRED EMBODIMENTS

Figure 1:
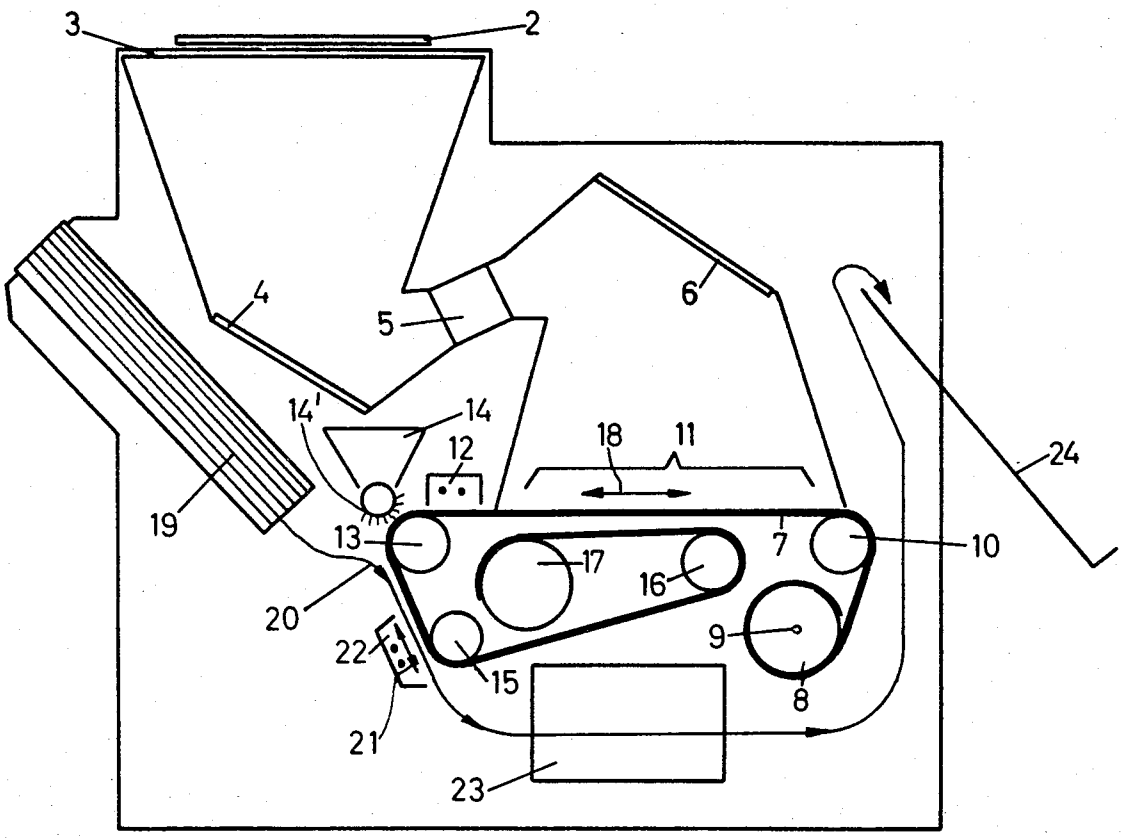
FIG. 1 diagrammatically illustrates a first exemplary embodiment.

In FIG. 1, the reference 1 denotes the image-producing apparatus as a whole. An original 2 to be copied is placed with its image side facing downwards on a glass plate 3. During the image-producing process, lamps (not shown in FIG. 1) periodically illuminate the image side of the original 2. Light reflected from the original 2 is projected by a first mirror 4 through an optical system 5 and by a second mirror 6 onto a sheet-form intermediate image carrier 7 provided with the photoconductor. In this first embodiment, the intermediate image carrier 7 consists of a flexible sheet of insulating material, for example "Mylar", with a thin metal coating and, over that metal coating, a photoconductor, for example ZnO, and binder.

One end of the intermediate image carrier 7 is wound onto a first roll 8. The first roll 8 is mounted for rotation about its axis 9 and is connected to a drive mechanism (not shown in FIG. 1). From the first roll 8, the intermediate image carrier 7 travels around a first guide roller 10 into an exposure zone 11. Inside the exposure zone 11, the image side of the original 2 is reproduced on that part of the intermediate image carrier 7 situated in the exposure zone or on its photoconductor by the optical means 4, 5 and 6 referred to above. Adjacent the exposure zone 11, there is a charging unit 12, for example a high-voltage corona, past which the intermediate image carrier 7 travels. The intermediate image carrier 7 then travels around a second guide roller 13. A magnetic brush 14 is arranged adjacent the guide roller 13. From the second guide roller 13, the intermediate image carrier 7 travels around a third guide roller 15 and then around a fourth guide roller 16 and finally onto a second roll 17.

The first roll 8 and the second roll 17 are coupled by a drive mechanism (not shown in FIG. 1) which enables the intermediate image carrier to travel either towards the first roll 8 or towards the second roll 17. In this way, it is possible to move the intermediate image carrier 7 in the two directions indicated by the double arrow 18 in the exposure zone 11.

The apparatus 1 further comprises a paper magazine 19 from which individual sheets can be taken, being guided over guide means (not shown in FIG. 1) along the path 20 to the intermediate image carrier 7. The paper enters a transfer zone 21 sheet by sheet. The transfer zone 21 is situated in the vicinity of the guide roller 15 and a transfer corona 22 arranged there for the transfer process.

After leaving the transfer zone 21, the intermediate image carrier 7 travels around the guide roller 15 to the guide roller 16, whilst the sheet of paper introduced into the transfer zone 21 is guided by further guide means (not shown in FIG. 1) first into a fixing zone 23 and then by further guide means (again not shown in FIG. 1) into an output zone 24. Now that the structure of the apparatus 1 has been established, the individual stages of an image-producing cycle will be described:

1. By switching on the drive means for the first roll 8 and second roll 17, the intermediate image carrier 1 is wound onto the first roll 8 and wound off from the second roll 17, so that it moves from left to right in the horizontal section of its travel in the vicinity of the exposure zone 11.
2. Before entering the exposure zone 11, the intermediate image carrier 7 is uniformly electrostatically charged by temporarily switching on the charging unit 12.
3. After it has entered the exposure zone 11, the intermediate image carrier 7 is briefly stopped and exposed according to the image side of the original 2 by switching on the lamps provided for the original 2. In this way, a latent electrostatic charge image is formed in known manner.
4. The drive means for the first roll 8 and the second roll 17 are then reversed, or kept in operation, in such a way that the intermediate image carrier 7 is now offwound from the first roll 8 and wound onto the second roll 17. Accordingly, the intermediate image carrier 7 moves from right to left in the horizontal section of its travel. The charging unit 12 is switched off.
5. As the intermediate image carrier 7 travels past the magnetic brush 14, the latent electrostatic charge image formed on it after exposure in the exposure zone 11 is developed to form a toner image by the deposition of toner onto the intermediate image carrier 7. According to the invention, a magnetic one-component toner, for example of the type described in U.S. Pat. No. 3,639,245, is provided for forming the brush coating 14' of the magnetic brush 14.
6. The intermediate image carrier with its toner image then passes through the transfer zone 21, in which the toner image is transferred to a sheet of paper taken from the paper magazine 19 and simultaneously introduced into the transfer zone 21 after the transfer corona 22 has been temporarily switched on.
7. After passing through the transfer zone, the sheet of paper now provided with the toner image passes through the fixing zone 23. Fixing may be obtained, for example, by infrared irradiation.

8. After the toner image has been fixed in the fixing zone 23, the now completed copy of the original 2 enters the output zone 24.
9. Before another image-producing cycle can be commenced, and at the very least when a new original 2 is to be copied, the intermediate image carrier 7 has to be cleaned. The residues of toner still adhering to it have to be removed. According to the invention, the intermediate image carrier 7 is cleaned by being returned from the second roller 17 to the first roller 8 by reversing the drive mechanism for the rollers 8 and 17 either immediately after the transfer process, but at the latest at the beginning of a new image cycle. During its return to the first roller 8, the intermediate image carrier 7 strips the coating 14' of the magnetic brush 14. By virtue of the fact that the one-component toner particles provided in accordance with the invention themselves contain magnetizable or magnetic material, the toner residues are magnetically attracted by the magnetic system present in the magnetic brush 14, in other words they are removed from the intermediate image carrier 7. It should be noted that this cleaning process does not involve the application of a d.c. voltage of certain polarity between the intermediate image carrier and the magnetic brush. It should also be noted that, by returning the toner residues, any reduction in the thickness of the brush coating 14' is counteracted insofar as the toner residues are introduced back into the coating. It should also be noted that there is no change in the developer because it consists of only one component, namely the magnetic or magnetizable toner particles. Accordingly, in contrast to magnetic brushes with magnetic particles and toner particles chargeable by frictional electricity which are introduced into the brush, the properties of the developer remain constant in accordance with the present invention. There is no reduction in the toner content.

According to the invention, the coating 14' of the magnetic brush 14 consists of toner particles which comprise, for example, a core of magnetizable or magnetic material covered by a layer of only limited conductivity. It should be noted that the toner itself has hardly any electrical charge, but can be magnetically attracted and, accordingly, may be used for forming the brush-like coating 14' of the magnetic brush 14. However, the toner particles can be attracted onto the intermediate image carrier 7 by an electrical field of the kind which emanates from the latent charge image on the intermediate image carrier 7, and may also be subsequently attracted again from the charge image carrier onto the opposite sheet of paper during the transfer process. It should be noted that, contrary to standard procedure, the magnetic brush 14 does not have to be applied to a voltage of predetermined polarity either for developing the latent charge image or for cleaning the intermediate image carrier, instead the electrical field emanating from the latent charge image is in itself entirely adequate for attracting the toner particles for developing the latent charge image.

The brush-like coating 14' of the magnetic brush 14 consisting of a magnetic one-component toner not only affords the practical advantage of simplifying the apparatus by eliminating the need for a special voltage source with an associated reversing switch, it also affords the further advantage of obviating the difficult problem of toner regeneration referred to earlier on. It is entirely sufficient to keep the level of the brush-like coating 14' constant, for example, by means of a stripper. There are no longer any problems in regard to the composition of the toner.

Figure 2:
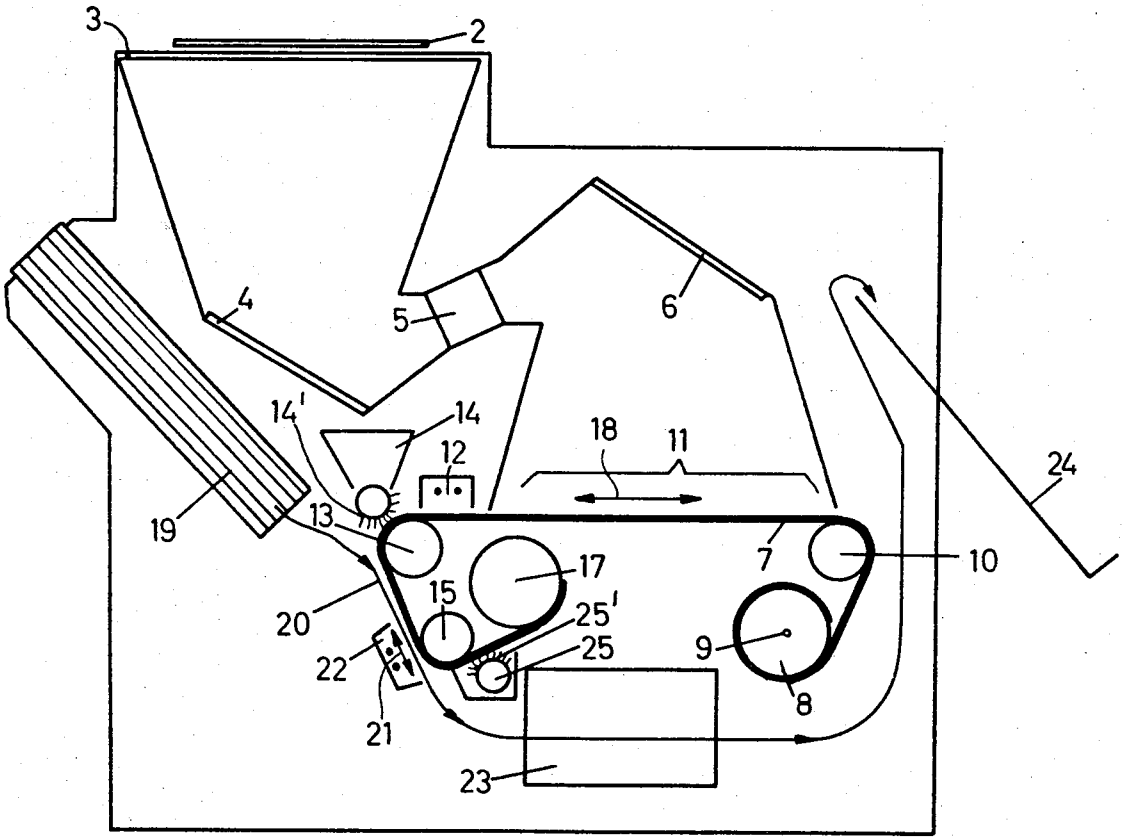
FIG. 2 diagrammatically illustrates a second exemplary embodiment.

FIG. 2 diagrammatically illustrates a second exemplary embodiment. The structure of the apparatus is largely the same as in FIG. 1. However, one difference is that the magnetic brush 14 is provided for development whilst another identical magnetic brush 25 is provided for cleaning the intermediate image carrier 7. The magnetic brush 25 provided for cleaning is preferably arranged in the vicinity of the guide roller 15. In the embodiment described with reference to FIG. 1, the intermediate image carrier is only cleaned during its return, i.e., as it passes the magnetic brush 14. Accordingly, it would be inappropriate, in the embodiment illustrated in FIG. 1, to wind the intermediate image carrier 7 after it has left the roll 15 directly onto the roll 17, because in that event the toner residues adhering to it would soil its lower surface after winding onto the roll 17. For this reason, the further guide roller 16 is provided in the embodiment shown in FIG. 1, so that the intermediate image carrier 7 travels an adequate distance before being wound onto the roll 17, so that soiled parts do not enter the roll 17. In the second embodiment shown in FIG. 2, however, the intermediate image carrier 7 is cleaned immediately after the guide roller 15, so that it is possible to wind it onto the second roll 17 immediately afterwards. This considerably simplifies the apparatus. A compact coating 25' is formed on the magnetic brush 25 over numerous cleaning cycles. When this coating has reached an adequate density, it is possible, for example, to remove the entire magnetic brush 25 from the apparatus and to use it, for example, as a replacement for the magnetic brush 14.

In addition to using a sheet-form charge image carrier 7, it is of course also possible to use a drum-like charge image carrier 7, in which case the individual components of the apparatus, namely the exposure stage, the charging stage 12, the magnetic brush 14, the transfer corona 12 and the second magnetic brush 25, if any, are arranged radially around the drum-like intermediate image carrier 7.

What is claimed is:

1. A process for electrographic image production, in which a latent image on an intermediate image carrier capable of being developed with a toner is developed with a one component toner and said intermediate image carrier is cleaned, comprising both developing the latent image on the intermediate image carrier and also cleaning the intermediate image carrier with at least one magnetic brush in the absence of applied voltage, wherein a magnetic one-component toner comprising a core of at least magnetizable material covered by a layer of only limited conductivity is used to form the brush-form coating on the magnetic brush.

2. A process as claimed in claim 1, wherein the development of the latent image on the intermediate image carrier capable of being developed with a toner and the subsequent cleaning of the intermediate image carrier of toner residues are carried out with one and the same magnetic brush, wherein the said magnetic one-component toner is used to form the brush-form coating on the magnetic brush.

3. An apparatus for carrying out the process according to claim 1, wherein at least one magnetic brush (14,25), includes a brush-like coating (14',25') comprising a magnetic one-component toner comprising a core of at least magnetizable material covered by a layer of only limited conductivity is provided for developing a latent image on an intermediate carrier and for removing toner residues from the intermediate image carrier, both in the absence of applied voltage.

4. An apparatus as described in claim 3, wherein two periodically interchangeable magnetic brushes having brush-like coatings comprising magnetic one-component toner comprising a core of at least magnetizable material covered by a layer of only limited conductivity are provided, one for developing the latent image on the intermediate carrier with said one-component toner and the other for removing toner residues from the intermediate image carrier, both operable in the absence of applied voltage.

* * * * *

UNITED STATES PATENT OFFICE

CERTIFICATE OF CORRECTION

PATENT NO. : 4,240,723

DATED : December 23, 1980

INVENTOR(S) : Gabor Forgo

It is certified that error appears in the above-identified patent and that said Letters Patent are hereby corrected as shown below:

IN THE SPECIFICATION:

Column 4, line 26, the numeral "1" at the end of the line should be --7--.

Column 4, lines 27, "wound off" should be --offwound--.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*